United States Patent [19]

DeLorenzo

[11] 4,206,532

[45] Jun. 10, 1980

[54] HINGE CONSTRUCTION

[76] Inventor: Mario M. DeLorenzo, P.O. Box 203, Glen Ellen, Calif. 95442

[21] Appl. No.: 938,325

[22] Filed: Aug. 30, 1978

Related U.S. Application Data

[63] Continuation-in-part of Ser. No. 763,368, Jan. 28, 1977, Pat. No. 4,713,056.

[51] Int. Cl.[2] ..... E05D 11/06

[52] U.S. Cl. ..... 16/191

[58] Field of Search ..... 16/128 R, 167, 171, 16/172, 191, DIG. 29; 220/335, 338, 315

[56] References Cited

U.S. PATENT DOCUMENTS

| | | | |
|---|---|---|---|
| 1,528,599 | 3/1925 | Belville | 16/171 |
| 1,791,693 | 2/1931 | Trussell | 16/167 |
| 2,839,779 | 6/1958 | Haag | 16/191 |
| 3,104,415 | 9/1963 | Stocker | 16/128 X |
| 3,235,903 | 2/1966 | Anderson | 16/128 R |

*Primary Examiner*—Husar C. J.
*Assistant Examiner*—Moshe I. Cohen

[57] ABSTRACT

Complementary portions arranged in opposed relationship comprising inflexible short segments having inner straight edges, and rolled long segments fitting spaced apart notches on each of said portions, and a pivot pin extending through passages defined by said rolled long segments.

6 Claims, 8 Drawing Figures

HINGE CONSTRUCTION

This application is a continuation-in-part of my copending application, Ser. No. 763,368 filed Jan. 28, 1977 and entitled FOLDABLE SAW HORSE, now U.S. Pat. No. 4,713,056 wherein I described, illustrated and claimed a specially constructed hinge in the environment of a saw horse for hingedly connecting together shelf sections thereof. The present invention is directed to such hinge construction as well as a modification thereof which is useful in many different environments as well as in the production of saw horses.

It is perhaps well known that a number of United States Letters Patent have issued for hinges of various types which are employed in various arts for hingedly interconnecting sections together whereby easy access is had to the various connected sections. An early hinge construction is disclosed in U.S. Pat. No. 1,916,209, issued on July 4, 1933 to Furlong wherein a visible index is illustrated consisting of tray sections for holding index cards with hinge means for introducing an additional section into the device; such hinge means comprising conventional hinge lugs and pintles to interconnect, pivotally, a center section on two outer sections. The hinge construction for the leaves of the book disclosed in U.S. Pat. No. 222,033 is formed on a back edge of a series of stubs which, in turn, form hinge points for the covers and leaves of a book, with pins e serving to removably secure together opposed tubes d'd', see FIG. 1. This hinge joint of U.S. Pat. No. 222,033 is made of rolled segments or tubes d, d' in alternation with spaces for receiving the rolled segments in a conventional construction.

Other prior patents relating to hinge constructions are U.S. Pat. Nos. 2,825,606, 3,431,430, 3,614,805 and 3,803,668, issued to Rebensdorf, Solomon, Barker and Remick respectively. The patents to Rebensdorf and Solomon primarily are directed to trestles or sawhorses with incorporated hinges of the conventional type. The patent to Barker is directed to a hinge fastener, per se, comprising a hinge body having a pintle receiving member on one edge thereof, and a flexible permanently deformable locking tongue projecting from the opposite edge of the body serving, when bent upon itself and passed through an adjacent planar sheet, to lock the hinge body to the planar sheets. The patent to Remick, U.S. Pat. No. 3,803,668, is directed to a pair of similarly fashioned hinge members having u-shaped open knuckles projecting outwardly from a straight edge of a plate element. This hinge construction of Remick is specific to prescribed shapes for specific adaptations and is restricted in its applications. None of the disclosures of these prior patents are suggestive nor do they teach applicant's relatively simple hinge construction in its preferred exemplification nor in its modified form, as will appear from the accompanying drawings.

A primary object of my invention is to provide a hinge construction which incorporates means for limiting the extent of movement of the hinge to afford increased rigidity to hingedly connected members.

Another important object of the present invention is to provide a hinged construction of the indicated nature which is additionally characterized by the provision of means therein to prevent longitudinal relative movement between the elements of the hinge per se.

A still further object of my present invention is to provide a hinge construction of the aforementioned character which is capable of inexpensive rapid manufacture from a minimum of parts, and readily assembled in locked condition in a number of different environments.

Other objects of the invention, together with some of the advantageous features thereof will appear from the following descriptions of a preferred and a certain modified embodiment of the invention which are illustrated in the accompanying drawings showing the best mode of construction and manner of using the exemplifications. It is to be understood that the appended claims are intended to cover not only the embodiments illustrated but also modifications thereof within the scope and purview of the invention.

Referring to the drawings.

In its best mode, the preferred embodiment of my present invention preferably comprises a pair of complementary hinge portions arranged in opposed relationship, a series of relatively inflexible short segments on the confronting edge of each of said hinge portions for abutting relation when said hinge portions are assembled, a series of rollable long segments on each of said hinge portions in off-set relationship to one another along the confronting edges thereof alternating with a series of notches for receiving said long segments, and a pintle pin extending through rolls of said long segments when said hinge portions are assembled and joined.

A modified mode of the hinge construction of my present invention comprises a pair of complementary hinge portions, a series of relatively inflexible short segments each having a straight inner edge thereon projecting from the confronting edges of said hinge portions with opposed short edges in abutment, a series of long segments on a confronting edge of one of said hinge portions arranged in pairs on opposite sides of said short segments on said one hinge portion, and a series of rollable long segments projecting from the confronting edge of the other of said hinge portions in off-set relation to said rollable long segments on said one hinge portion, a series of notches on the confronting edges of said hinge portions for receiving said rollable long segments when said pair of hinge portions are assembled, and a pintle pin extending through rolled long segments to join said hinge portions together.

Figure 1:
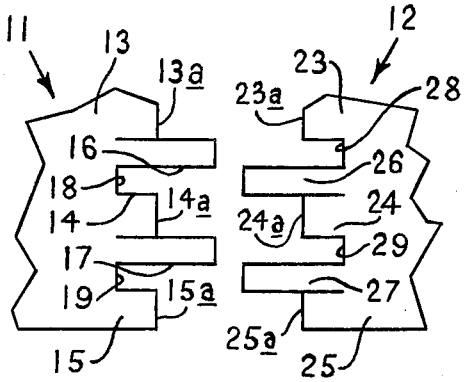
FIG. 1 is an exploded fragmentary plan view of complementary members of my novel hinge construction employable for holding elements in swingable relationship with abutting confronting edges.
Figure 2:
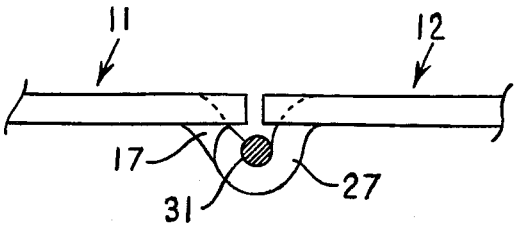
FIG. 2 is an end elevational view of my novel hinge construction as assembled.
Figure 3:
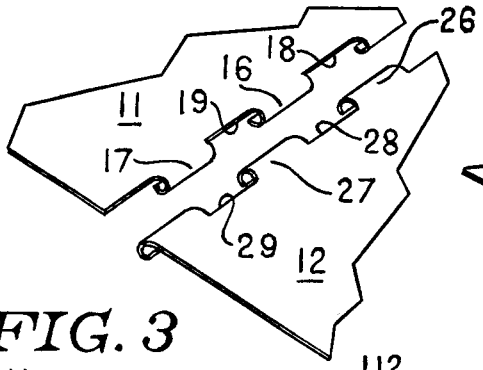
FIG. 3 is an enlarged fragmentary detail of the outer confronting edges of the hinge portions of a piano type hinge.

In accordance with my invention as illustrated in FIGS. 1 and 2 inclusive of the accompanying drawings, I provide a pair of metal strips 11 and 12 which are fabricated from flat light-weight metal stock such as aluminum or aluminum alloy but which can be made from fibreglas or molded from a suitable plastic material, as desired. Preferably the strips or hinge portions 11 and 12 are stamped from such stock utilizing a conventional punch press equipped with dies, not shown, for also fashioning the confronting edges of such hinge portions 11 and 12 upon each operation of the press as the strips are fed through the same usually to stamp out one portion at the left followed by stamping out the other portion at the right of the strips.

As illustrated particularly in FIG. 1, the confronting edge of strip 11 is so fashioned as to provide thereon relatively inflexible short segments 13, 14 and 15 each having a straight inner edge 13*a*, 14*a* and 15*a* and spaced from one another; such construction also providing spaced apart rollable long segments 16 and 17 contiguous to short segment 13 and intermediate short segment 14 in slitted relation thereto, as well as providing spaced apart notches 18 and 19 along side said rollable long segments 16 and 17. The stamping 12 is so fashioned as to provide a confronting edge thereon having a series of spaced apart relatively inflexible short segments 23, 24 and 25, each having a straight inner edge 23*a*, 24*a*, and 25*a*; such fashioning of the strips 11 and 12 at their confronting edges placing the short segments 13 and 23; 14 and 24; and 15 and 25 in alignment in pairs when the two hinge portions are brought together in assembled relation, with the inner straight edges of the aligned short segments abutting one another, thereby limiting the swing of the hinge portions and affording a more rigid relationship between sections interconnected by the improved hinge connection herein described.

Figure 4:
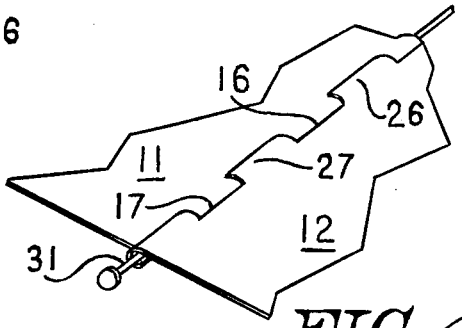
FIG. 4 is a view similar to FIG. 3 but with the hinge portions in assembled state.

The fashioning of portion 12 on its confronting edge also provides a series of rollable long segments 26 and 27 which are in spaced relation to one another to define spaced apart notches 28 and 29 contiguous to the short segments 24 and 25 in slitted relation thereto to permit the rolling of the long segments 26 and 27 into corresponding notches in hinge portion 11. When the hinge portions 11 and 12 are assembled, after first rolling the long segments 16 and 17 of portion 11 and the long segments 26 and 27 of hinge portion 12 in the manner illustrated in FIG. 2, the rolled segments enter the corresponding notches in the opposed confronting edges, and a pintle pin 31 is then inserted through the rolls of the rolled long segments, as shown in FIG. 4.

A modified hinge construction of my present invention is illustrated in FIGS. 5 to 8 inclusive of the accompanying drawings; such modification functioning not only to limit the swing of the connected hinge portions, as in the case of the embodiment illustrated in FIGS. 1 to 4 inclusive, but also to prevent longitudinal movement of the hinge portions relative to one another. As shown, I provide a pair of hinge portions 111 and 112 which are fabricated from light-weight metal stock, such as aluminum alloy or made from fibreglas or molded from a suitable plastic material, in flat strips, and which are so fashioned on their confronting edges as to provide a series of short inflexible segments as well as spaced apart long segments wherein the latter interlock with one another and the former are in abutting relationship to one another when the two strips are assembled for joinder.

In accordance with my invention in the modification of FIGS. 5 to 8 inclusive, I so fashion the hinge portions 111 and 112, utilizing a punch press equipped with dies, as to provide the confronting edge of portion 111 with two pairs of spaced apart rollable long segments 113, 114 and 116, 117 with each pair of the rollable long segments arranged on opposite sides of and contiguous to a single relatively short segment 118 and 119 in slitted relationship thereto to permit rolling of the long segments; and also provide on the confronting edge of hinge portion 111 spaced apart notches 120 and 120*a* and 120*b* for receiving the rolled segments of the opposed hinge portion as hereinafter explained.

Figure 5:
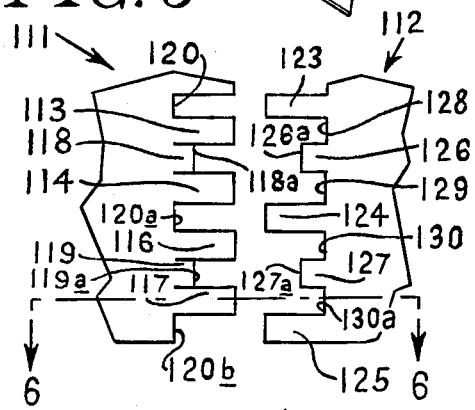
FIG. 5 is an exploded fragmentary plan view of a modified embodiment of the invention.
Figure 7:
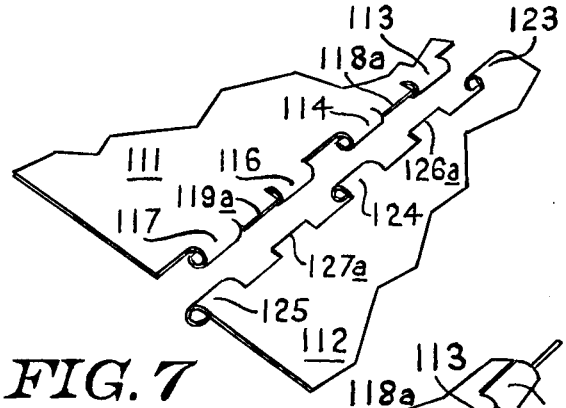
FIG. 7 is an enlarged exploded perspective view of the modified hinge portions of FIG. 5.
Figure 6:
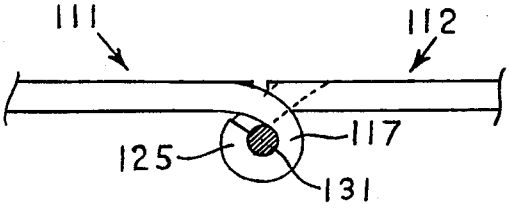
FIG. 6 is an end elevational view of the hinge portions shown in FIG. 5 but in assembled state.
Figure 8:
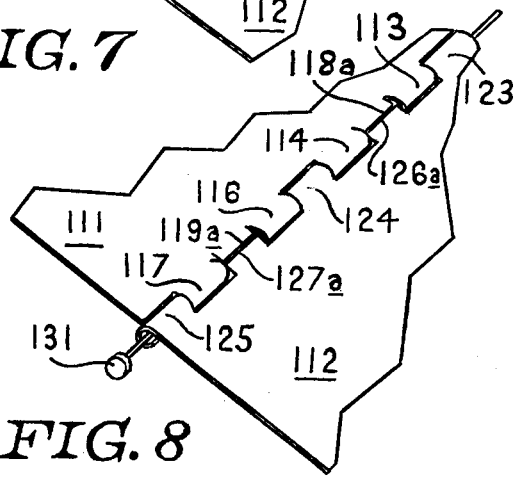
FIG. 8 is a view similar to FIG. 7 but with the hinge portions in assembled state.

Further, with particular reference to FIG. 5 it will be observed that I so fashion hinge portion 112 as to provide a confronting edge containing a series of off-set rollable long segments 123, 124 and 125, as well as to provide thereon a series of relatively inflexible short segments 126 and 127 in spaced relation to one another between said long segments; each of said short segments having a straight-inner edge 126*a* and 127*a* which abut the inner straight edges 116*a* and 117*a* of said hinge portion 111 when the two portions are assembled and joined together in use. The fashioning of the confronting edge of hinge portion 112 by the punch press also provides a series of notches 128 and 129 as well as 130 and 130*a* on opposite sides of said long segments for receiving the rolled long segments 113, 114 and 116 and 117 of hinge portion 111 when the two hinge portions are assembled and a pintle pin is passed through the rolls of the rolled long segments as illustrated in FIGS. 6 and 7 of the drawings. It is to be observed that the spacing of the pairs of long segments 113, 114 and 116, 117 on hinge portion 11 in relation to the spacing of the long rollable segments 123, 124 and 125 on the confronting edge of hinge portion 112, and the corresponding locations of the notches 120, 120*a* and 120*b* on hinge portion 111 in relation to the locations of the notches 128, 129, 130 and 130*a* on hinge portion 112 for the reception of the rolled long segments when the hinge portions are brought together for joinder with the pintle pin 131, prevents the relative movement between the two hinge portions so that no longitudinal movement there between occurs when in use.

The improved hinge construction of the invention affords use of two different types of hinges in one structure. For example, the hinge construction illustrated in FIGS. 3 and 5 can be effectively employed at the meeting edges of half sections, such as the shelf sections 38 and 39 of the foldable saw horse shown in my copending patent application, Ser. No. 763,368, while the piano hinge of FIG. 4 can be used to connect the outer edges of the shelf sections to other parts of the saw horse.

It is to be understood that the appended claims are intended to cover the embodiments of my invention shown in the annexed drawings as well as modifications thereof within the scope and purview of the invention.

I claim:

1. A hinge comprising a pair of complementary portions arranged in opposed relationship; each of said portions being slitted between inflexible short segments having inner straight edges and rolled long segments contiguous thereto, and spaced apart notches on each of said portions for receiving said long segments, and a pivot pin extending through passages defined by said rolled long segments wherein said inner straight edges of said short segments are in abutting relation to one another to limit the relative pivotal movement of said complementary portions.

2. A hinge connection comprising a pair of complementary hinge portions arranged in opposed relationship, a series of relatively inflexible short segments of equal length on the confronting edge of each of said hinge portions in abutting relationship, a series of rollable long segments of equal length on each of said hinge portions in off-set relationship with one another along the confronting edges thereof alternating with a series of notches for receiving said long segments, and a pintle pin extending through formed rolls of said rollable long segments for joining said hinge portions together.

3. A hinge construction comprising a pair of complementary hinge portions each having a confronting edge when joined, a series of pairs of rolled long segments arranged in spaced relationship to one another on the confronting edge of one of said pair of hinge portions, a relatively inflexible short segment on said confronting edge of said one hinge portion between each pair of said rolled long segments thereon; each of said short segments having a straight inner edge, notches in said confronting edge of said one hinge portion on opposite ends thereof and between said pairs of rolled long segments, a series of rolled long segments on the confronting edge of said other hinge portion of said pair of hinge portions arranged in spaced relationship to one another, a pair of relatively inflexible short segments on said confronting edge of said other hinge portion; each of said short segments having a straight inner edge and extending between said rolled long segments in alignment with said short segments on the confronting edge of said one hinge portion, notches in the confronting edge of said other hinge portion located on opposite sides of said rolled long segments for receivimg said pairs of rolled long segments on the confronting edge of said one hinge portion, and a pintle pin passing through said rolled segments for joining said hinge portions together in swingable relation to one another with the inner edges of said short segments in abutment with one another and said rolled long segments locked in said notches preventing relative longitudinal movement between said hinge portions.

4. A hinge construction as set forth in claim 3 wherein said rolled long segments of said one hinge portion are off-set in relation to said rolled long segments of said other hinge portion.

5. A hinge construction as set forth in claim 3 wherein said short segments of said other hinge portion are equally spaced apart from said rolled long segments on the confronting edge of said other hinge portion.

6. A hinge construction as set forth in claim 5 wherein said short segments of said one hinge portion are aligned with said short segments of said other hinge portion when joined.

* * * * *